US008505250B2

(12) United States Patent
Vanhastel

(10) Patent No.: US 8,505,250 B2
(45) Date of Patent: Aug. 13, 2013

(54) FINISHING FOR A STAIRCASE OR STEP, AND KIT FOR FORMING SUCH FINISHING

(75) Inventor: Luc Vanhastel, Tielt (BE)

(73) Assignee: Flooring Industries Limited, SARL, Bertrange (LU)

( * ) Notice: Subject to any disclaimer, the term of this patent is extended or adjusted under 35 U.S.C. 154(b) by 106 days.

(21) Appl. No.: 13/109,397

(22) Filed: May 17, 2011

(65) Prior Publication Data

US 2011/0283636 A1 Nov. 24, 2011

(30) Foreign Application Priority Data

May 18, 2010 (BE) ..... 2010/0296
Oct. 4, 2010 (BE) ..... 2010/0583

(51) Int. Cl.
*E04F 11/16* (2006.01)

(52) U.S. Cl.
USPC ..... 52/179; 52/288.1

(58) Field of Classification Search
USPC ..... 52/179, 288.1, 466, 582.1
See application file for complete search history.

(56) References Cited

U.S. PATENT DOCUMENTS 5,806,253 A * 9/1998 Nelson ..... 52/179
6,115,975 A * 9/2000 Abdollahi ..... 52/179
2005/0229517 A1 10/2005 Gomez Insa
2007/0193172 A1* 8/2007 Stanchfield ..... 52/470
2010/0287869 A1* 11/2010 Stanchfield ..... 52/464

FOREIGN PATENT DOCUMENTS

| | | |
|---|---|---|
| DE | 4325998 | 3/1994 |
| EP | 1681402 | 7/2006 |
| EP | 1836363 | 7/2006 |
| ES | 2328204 | 11/2009 |
| FR | 2881158 | 7/2006 |
| WO | 9747834 | 12/1997 |
| WO | 2006093866 | 9/2006 |
| WO | 2007139595 | 12/2007 |
| WO | 2007142841 | 12/2007 |

OTHER PUBLICATIONS

Search report of Belgium Patent Office relating to Belgium Patent Application No. 2010/00296, Jan. 31, 2011.

* cited by examiner

*Primary Examiner* — Basil Katcheves
(74) *Attorney, Agent, or Firm* — Workman Nydegger

(57) ABSTRACT

Finishing for a staircase or step that includes at least a decorative strip and a floor panel, wherein the floor panel is provided with a profiled edge region in the form of a coupling arrangement. The finishing also includes an adapting profile that cooperates with the body of the decorative strip and the adapting profile has a surface, which, at the location of the coupling arrangement, extends transversely relative to the decorative side of the floor panel. The surface has a profile offering room for at least a portion of the coupling arrangement.

11 Claims, 5 Drawing Sheets

FINISHING FOR A STAIRCASE OR STEP, AND KIT FOR FORMING SUCH FINISHING

BACKGROUND OF THE INVENTION

1. Field of the Invention

This invention relates to a finishing for a staircase or a step, more particularly to a covering for an existing staircase or step. Such finishing or covering may be applied, for example, when renovating an existing staircase. Further, the invention also relates to a kit for forming such finishing.

2. Related Art

In particular, the invention relates to a finishing for a staircase or a step, which can be realized starting from floor panels. Herein, this relates in particular to floor panels which can be floatingly installed, such as, for example, laminate panels, prefabricated parquet, veneer parquet, or solid parquet. Such floor panels usually are provided at their edges with mechanical coupling means allowing to lock two or more such floor panels together at their edges, without herein implicitly requiring the use of glue. They may, however, also be provided with traditional tongue-in-groove couplings, which then preferably indeed are glued into each other.

Decorative strips allowing to form, together with such floor panels, a finishing for a staircase or step, are known, for example, from document EP 1 681 402 and DE 43 25 998. Herein, respectively a decorative strip is applied, which forms at least the stair nose and cooperates with a floor panel provided on the step. In these cases, this respectively concerns a so-called "flush" finishing, wherein the step is free from height differences between the respective decorative sides of the decorative strip and the floor panel. The decorative strip is in each case adapted, for example, in thickness, to the floor panel with which it has to cooperate and further does not allow any variation in finishing.

The patent documents US 2005/229,517, WO 2006/093866, WO 2007/139595 and WO 2007/142841 describe decorative strips for finishings of a staircase, wherein these decorative strips as such comprise a body which comprises a plurality of parts provided with a decorative side. Finishing a staircase wherein the decorative sides of the decorative strip and the floor panel are in the same plane, a so-called "flush" finishing, is impossible with the solution from these patent documents. Moreover, the decorative strips known here do not allow any variation in the finishing of the step.

SUMMARY OF THE DISCLOSURE

The present invention aims in particular to an alternative finishing for a staircase or step, wherein use is made of a decorative strip and a floor panel. According to various preferred embodiments, the invention offers a solution for one or more disadvantages with the finishing methods of the state of the art. To this aim, the invention, according to a first independent aspect, relates to a finishing for a staircase or step, wherein this finishing comprises at least a decorative strip and a floor panel, wherein said decorative strip has a body comprising a plurality of parts provided with a decorative side, and wherein said floor panel also comprises a decorative side and is provided with a profiled edge region in the form of a coupling means of the type allowing to couple a plurality of such floor panels to each other at their edges, wherein the decorative side of the decorative strip and the decorative side of the floor panel adjoin each other, with the characteristic that at least one of said parts of the body of the decorative strip comprises a surface which, at the location of the connection of the respective decorative sides of the decorative strip and the floor panel, extends transverse in respect to the decorative side of the floor panel, wherein said surface shows a profile which offers room for at least a portion of said coupling means.

Due to the presence of a plurality of parts provided with a decorative side and the profiling of the transverse surface, which offers room for at least a portion of the coupling means of the floor panel, an elegant finishing is obtained which can be realized in different ways. The elegant finishing consists in the connection of the respective decorative sides. By "connection" of the respective decorative sides is meant that the possible distance between the respective edges of these decorative sides is smaller than 1 millimeter. Preferably, the connection is so close that, to the user, there is no visible gap present between the respective edges of the decorative sides.

Preferably, the edge of the decorative side of the floor panel as well as the edge of the decorative side of the decorative strip are visible in the finally finished step or staircase, still better they will contact each other.

According to a preferred embodiment, said decorative sides adjoin each other without overlapping each other thereby.

According to another preferred embodiment, whether or not using the preceding preferred embodiment, at said connection the aforementioned decorative sides are situated in the same plane.

According to the above-mentioned preferred embodiments, preferably a contact surface is formed between the floor panel and the decorative strip at the location of the profiled edge region, respectively said surface extending transverse in respect to the decorative side of the floor panel.

Preferably, the aforementioned coupling means substantially is realized as a tongue and does the profiled surface of the decorative strip offer room for the portion of said tongue extending beyond the edge of the decorative side of the floor panel. However, of course it is not excluded that said coupling means would be substantially realized as a groove, flanked by an upper lip and a lower lip, wherein the profiled surface of the decorative strip then offers room for a portion of the upper and/or lower lip extending beyond the edge of the decorative side of the floor panel.

Preferably, said decorative strip and said floor panel are positioned with their longitudinal direction parallel and with their width direction transverse to each other, wherein the decorative strip, at choice, either is provided on a step or covers or forms the stair nose. Corresponding to this choice, the floor panel, for the coupling means of which room is offered by means of the transverse surface of the decorative strip, can either be positioned vertically, or at least form at least partially the rising flank of the covered step, or can be positioned horizontally, or at least form at least partially the surface of the step. Corresponding to this choice, said connection between the respective decorative sides of decorative strip and floor panel then is formed either on said rising flank, or on the surface of said step.

According to a particular embodiment, said parts of the decorative strip are connected to each other at least by means of a layer-shaped covering, wherein this layer-shaped covering forms said decorative side of the respective parts. Preferably, for the finishing of the invention, substantially a decorative strip is applied of the type which as such is known from document EP 1 836 363, however, wherein the respective transverse surface is provided with a profile in such a manner that, as aforementioned, it can offer room for the coupling means of the floor panel. The decorative strip known as such from document EP 1 836 363 allows, by removing two or more of said parts from each other or combining them with each other, forming different transition profiles for floor coverings, such as expansion profiles, end profiles, transition profiles and skirting boards. By providing the transverse surface of one or more of said parts with a profile, the present invention also offers the possibility of employing such decorative strip as a versatile stair profile. It is clear that the decorative strip, which according to the present invention is applied in a finishing for a staircase or step, as such also forms the object of the invention, whether or not in combination with the attachment rail possibly to be applied therewith.

Preferably, the finishing of the invention further also comprises an attachment rail for said decorative strip, wherein said attachment rail cooperates with at least one of the aforementioned parts of the decorative strip. Preferably, said rail substantially is made in an L-shape, wherein preferably the longer leg of this L-shape is provided underneath the floor panel.

Preferably, the attachment rail is dimensioned such that a "flush" finishing can be obtained on the surface of the step. It is possible that to this aim, depending on the thickness of the floor panel, a differently dimensioned attachment rail is offered. On the other hand, it is also possible that the attachment rail is adaptable, for example, in that this rail comprises removable or combinable portions, which allow, when removing or combining these portions or not, to obtain a "flush" finishing with floor panels of another thickness.

With the same purpose as in the first aspect, the present invention, according to an independent second aspect, also relates to a finishing for a staircase or step, wherein this finishing comprises at least a decorative strip and a floor panel, wherein said decorative strip has a body which is provided with a decorative side, and wherein said floor panel also has a decorative side and is provided with a profiled edge region in the form of a coupling means of the type allowing to connect a plurality of such floor panels to each other at their edges, with the characteristic that said finishing also comprises an adapting profile, wherein said adapting profile cooperates with the body of said decorative strip and the adapting profile shows a surface which, at the location of said coupling means of the floor panel, extends transverse in respect to the decorative side of the floor panel, wherein this surface comprises a profile which offers room for at least a portion of said coupling means. The use of an adapting profile allows obtaining a more qualitative direct or indirect cooperation between the decorative strip and the floor panel. Moreover, the adapting profile allows adapting the same decorative strip with different adapting profiles, such that this decorative strip can cooperate with differently formed and/or positioned coupling means. The use of an adapting profile enhances the universal applicability of the decorative strip. It is clear that the adapting profile preferably can be chosen from a series of two or more different adapting profiles and/or that the adapting profile can be modified by the user, such that it can be applied at least in two different configurations.

Preferably, said adapting profile shows a vertically active contact surface with said coupling means. Such vertically active contact surface preferably restricts the extent to which the floor panel can move away in a direction transverse to the decorative side of the staircase or step. In this manner, the adapting profile contributes to flattening possibly warped panels and allows obtaining a "flush" finishing also with non-flat panels.

Preferably, said decorative strip comprises a body which as such comprises a plurality of parts, for example, a body as described by means of the first aspect.

The invention of the second aspect preferably further is characterized in that the decorative side of the decorative strip and the decorative side of the floor panel adjoin each other, preferably without overlapping thereby. Preferably, both decorative sides extend at the location of the connection globally in the same horizontal plane. According to the present preferred embodiment, the adapting profile is not or almost not visibly present at the surface of the finishing; in fact, this adapting profile extends exclusively underneath the surface of the finishing. However, it is not excluded that such adapting profile should comprise a portion which is present at the surface of the finishing. Such portion may form, for example, an anti-slip strip.

Preferably, the adapting profile has a U-shaped cross-section, which comprises at least a groove flanked by an upper lip and a lower lip, and said coupling means is made in the form of a tongue, wherein the tongue is at least partially provided in said groove.

Preferably, said adapting profile is provided at least partially in an undercut provided in said decorative strip.

Preferably, said decorative strip and said floor panel are positioned with their longitudinal direction parallel and with their width direction transverse to each other, wherein the decorative strip, at choice, either is provided on a stair nose or covers or forms the stair nose.

According to the second aspect, the finishing preferably further also comprises an attachment rail for said decorative strip, wherein this attachment rail cooperates at least with the decorative strip, preferably in that the decorative strip is attached directly to this rail. Preferably, the combination of an appropriate adapting profile and an appropriate attachment rail allows obtaining with the same decorative strip a "flush" finishing by means of different types of floor panels, wherein these different types of floor panels differ at least from each other by their thickness and/or the form and/or geometry of their coupling means.

Preferably, said attachment rail substantially is made in an L-shape, wherein the longer leg of this L-shape is provided underneath the floor panel and the shorter leg preferably is provided with an attachment portion for providing said decorative strip thereon.

It is clear that the finishing of the second aspect further can also show the characteristics of the finishing of the first aspect, wherein the adapting profile then preferably forms part of the decorative strip.

The invention further also relates to a kit, which comprises a decorative strip and an attachment rail for finishing a staircase or step, wherein the decorative strip allows obtaining a finish of a staircase or step with the characteristics of the invention or the preferred embodiments thereof. Preferably, the attachment rail is made in an L-shape and still better shows the optional characteristics thereof mentioned above or below.

In general, the invention, according to a third independent aspect, also relates to a kit for forming a finishing according to any of the aforementioned aspects, with the characteristic that said kit meets at least one of the following features:

- the kit comprises a decorative strip, which forms at least the stair nose, and an attachment rail;
- the kit comprises an attachment rail and an adapting profile;
- the kit comprises a decorative strip, which forms at least the stair nose, and an attachment rail.

Preferably, the body of the decorative strip comprises a flange-shaped part with an attachment portion situated underneath and cooperating with said attachment rail. Preferably, this relates to a part which, in cross-section, substantially is made in a T-shape. According to a particular preferred embodiment, the body further also comprises one or more nose portions, which substantially are situated underneath said flange-shaped part. Preferably, said nose portions are provided with a decorative side, which adjoins the decorative side of the flange-shaped part and still better forms a whole therewith. Preferably, said adjoining to the decorative side of the floor panel is obtained in between the decorative side of one of said nose portions. In such case, it is preferably a surface of the respective nose portion which shows said profile. The surface which shows the profile, preferably is a functional surface, which is free from decorative elements, or, in other words, is no part of the decorative side of the respective part and/or the decorative strip.

The specific arrangement of a decorative strip with a flange-shaped part and one or more parts substantially situated there beneath, offers a plurality of possibilities for applying such decorative strip in general and for finishing a staircase or step in particular.

Preferably, the different component parts of the kit of the third aspect are packaged together, preferably at least in that they are in the same box or foil. Preferably, the length of the component parts of the kit is equal.

In respect to the adapting profile and the attachment rail, it is noted that they do not necessarily have to be made as long profiles, namely, not necessarily with a length substantially corresponding to that of the decorative strip. Namely, they may also be made as a plurality of separate adapting parts and/or attachment strips, of which then a plurality must be applied for finishing one step.

Preferably, the finishing, according to all aspects of the invention, also comprises glue connections or adhesive connections, to wit between the attachment rail and the staircase or step to be finished, between the floor panel and the attachment rail, between the decorative strip and the floor panel and/or the adapting profile. The attachment rail can also be attached to the staircase or step by means of a screw connection.

BRIEF DESCRIPTION OF THE DRAWINGS

With the intention of better showing the characteristics of the invention, hereafter, as an example without any limitative character, some preferred embodiments are described, with reference to the accompanying drawings, wherein.

DETAILED DESCRIPTION OF PREFERRED EMBODIMENTS OF THE INVENTION

Figure 1:
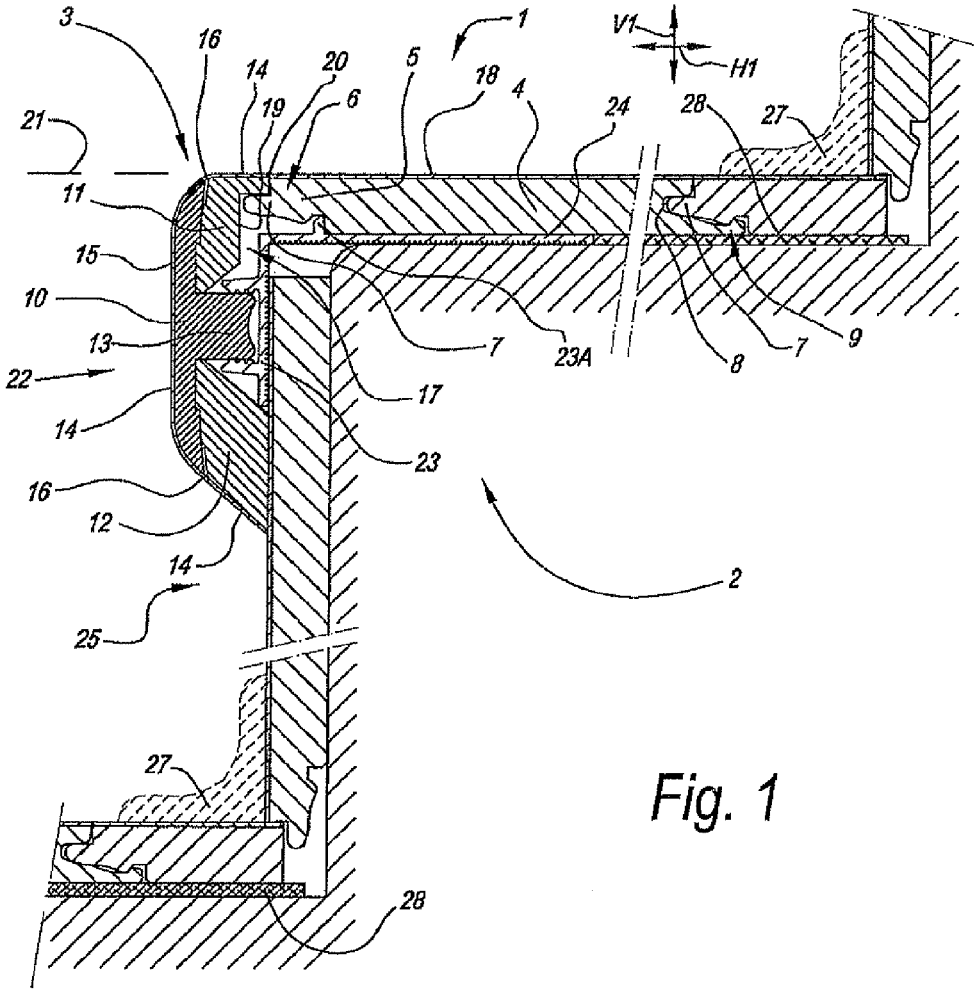
FIG. 1 in cross-section represents a finishing for a staircase with the characteristics of the invention.

FIG. 1 represents a finishing 1 for a staircase 2, which comprises at least a decorative strip 3 and a floor panel 4. At two opposite sides, the floor panel comprises profiled edge regions 5, which comprise coupling means 6. The coupling means 6 in this case are of a type known as such, for example, from WO 97/47834. Herein, in the example this relates to mechanical coupling means, which allow that a plurality of such floor panels 4 can be connected to each other at their edges concerned, and wherein in connected condition a locking is obtained of the respective edges in a horizontal direction H1 perpendicular to this edge and in the plane of the interconnected floor panels 4, as well as in a vertical direction V1 perpendicular to said plane. To this aim, the coupling means 6 of the floor panel from the example substantially are made as a tongue and groove coupling, which effects the locking in the vertical direction V1, wherein this tongue 7 and groove 8 are provided with locking means or locking parts 9, which effect the locking in horizontal direction H1.

Said decorative strip 3 comprises a body with a plurality of parts 10-11-12. In this case, three parts 10-11-12 are represented: a flange-shaped part 10, which is provided with an attachment portion 13 on the lower side and substantially has a T-shaped cross-section, and two nose portions 11-12, which are situated underneath the flange-shaped part 10.

Figure 2:
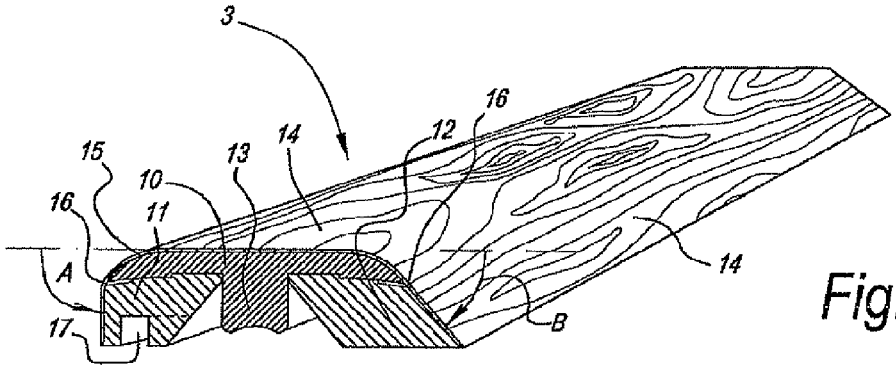
FIG. 2 in perspective represents the decorative strip applied in FIG. 1.

FIG. 2 shows that these parts 10-11-12 each have a decorative side 14, wherein the decorative side 14 of the aforementioned nose portions 11-12 each adjoin to the decorative side 14 of the flange-shaped part 10. In this case, the decorative sides 14 of the nose portions 11-12 and the decorative side 14 of the flange-shaped part 10 form a whole. To wit, in this case the decorative side 14 is formed as a layer-shaped covering 15, for example, a laminate, foil or veneer, which extends uninterruptedly over the transition 16 between the respective parts 10-11-12. In this manner, this layer-shaped covering 15 forms the connection between the parts 10-11-12. According to the invention, the parts 10-11-12 of course also may comprise other mutual connections, whether or not in combination with a connection by means of a layer-shaped covering 15, which extends over the transition 16 between the parts 10-11-12. These other mutual connections may be chosen, for example, from a connection by means of a weakened material portion, an adhesive connection, a tongue-in-groove connection or the like. The parts 10-11-12 may also be connected to each other in an indirect manner, for example, by means of an underlying rail. The connections between the individual parts 10-11-12 are always made such that they can be separated, however, not necessarily such that they can be re-established.

The decorative sides 14 of the nose portions 11-12 show a mutually different inclination A-B. This feature allows, with removal of one of the nose portions 11-12, at choice, to obtain the typical shape either of an end profile for a floor covering or of a transition profile for a floor covering. An end profile can be applied, for example, for finishing a floor covering against a wall instead of a finishing with a skirting board or as a finishing against a skirting board. A transition profile can be applied at the edge of a floor covering, where a transition to another type of floor covering must be finished, for example, in a door opening. When both nose portions 11-12 are removed and, in this case, only the flange-shaped part 10 or the flange-shaped portion is retained, this can be applied for finishing an expansion joint in the surface of a floor covering. For examples of transition profiles, end profiles and expansion or extension profiles, reference is made to the already above-mentioned document EP 1 836 363.

Preferably, at least one of the aforementioned nose portions 11, such as here, shows an inclination A of approximately 90° with the surface or the decorative side 14 of the flange-shaped part 10. Preferably, this relates to the nose portion 11 showing the profile 17 of the invention. In this manner, a very elegant finishing can be obtained. Preferably, the other nose portion 12 then shows an inclination B of less than 90° with the decorative side 14 of the flange-shaped part 10, for example, an inclination B of 65° or less, wherein an inclination B of approximately 50° is a good value.

The present invention relates to a further application of such decorative strip 3, to wit the use thereof as a decorative strip 3 when finishing a staircase 2 or a step. As represented in FIG. 1, according to the invention the decorative side 14 of the decorative strip 3, in this case the decorative side 14 of one of the nose portions 11, and the decorative side 18 of the floor panel 4 adjoin each other, in this case without overlapping each other. To this aim, the respective nose portion 11 has a surface 19, which, at the location of the connection 20, extends transverse in respect to the decorative side 18 of the floor panel 4, wherein this surface 19 is provided with a profile 17, which offers room for a portion of a coupling means 6 of the aforementioned floor panel 4. In this case, the profile 17 offers room for the coupling means 6, which substantially is made in the form of a tongue 7, more particularly for that portion of this tongue 7 which extends beyond the edge of the decorative side 18 of the floor panel 4. In the represented example, a so-called "flush" finishing is obtained. With said connection, the decorative sides 14 of the decorative strip 3 and the floor panel 4 extend in the same plane, to wit in the plane 21 of the finished step.

It is clear that the decorative strip 3 applied here substantially has the shape of the finishing profile disclosed in the document EP 1 836 363, however, wherein one of the nose portions 11 shows a profile 17, which, as aforementioned, offers room for a coupling means 6 of a pertaining floor panel 4.

As clearly represented, the decorative strip 3 and the floor panel 4 are positioned with their width direction transverse to each other, wherein the decorative strip 3 forms the stair nose 22. The floor panel 4 forms at least a part of the plane 21 of the finished step.

For the attachment of said decorative strip 3, an attachment rail 23 is attached to the step. This may be performed, for example, by means of a glue and/or screw connection. Such connection is not represented here. In this case, the attachment rail 23 preferably is attached to the horizontal surface of the step. The attachment rail 23 cooperates with said attachment part 13 of the body of the decorative strip 3, which then in this case forms part of the aforementioned flange-shaped part 10. The attachment rail 23 is substantially made in an L-shape, wherein the longer leg 24 of this L-shape is provided underneath the floor panel 4.

FIG. 1 also shows that the rising flanks 25 of the steps can be covered with floor panels, such that a completely renovated staircase surface is obtained.

FIG. 2 shows different possibilities for said profile 17. A profile 17 in the form of a groove in the surface 19 concerned is represented in solid line, wherein this groove is defined by means of two flanks, which do not necessarily have to be of equal length, such as shown here. A profile 17 in the form of a recessed edge is represented in dashed line.

Figure 3:
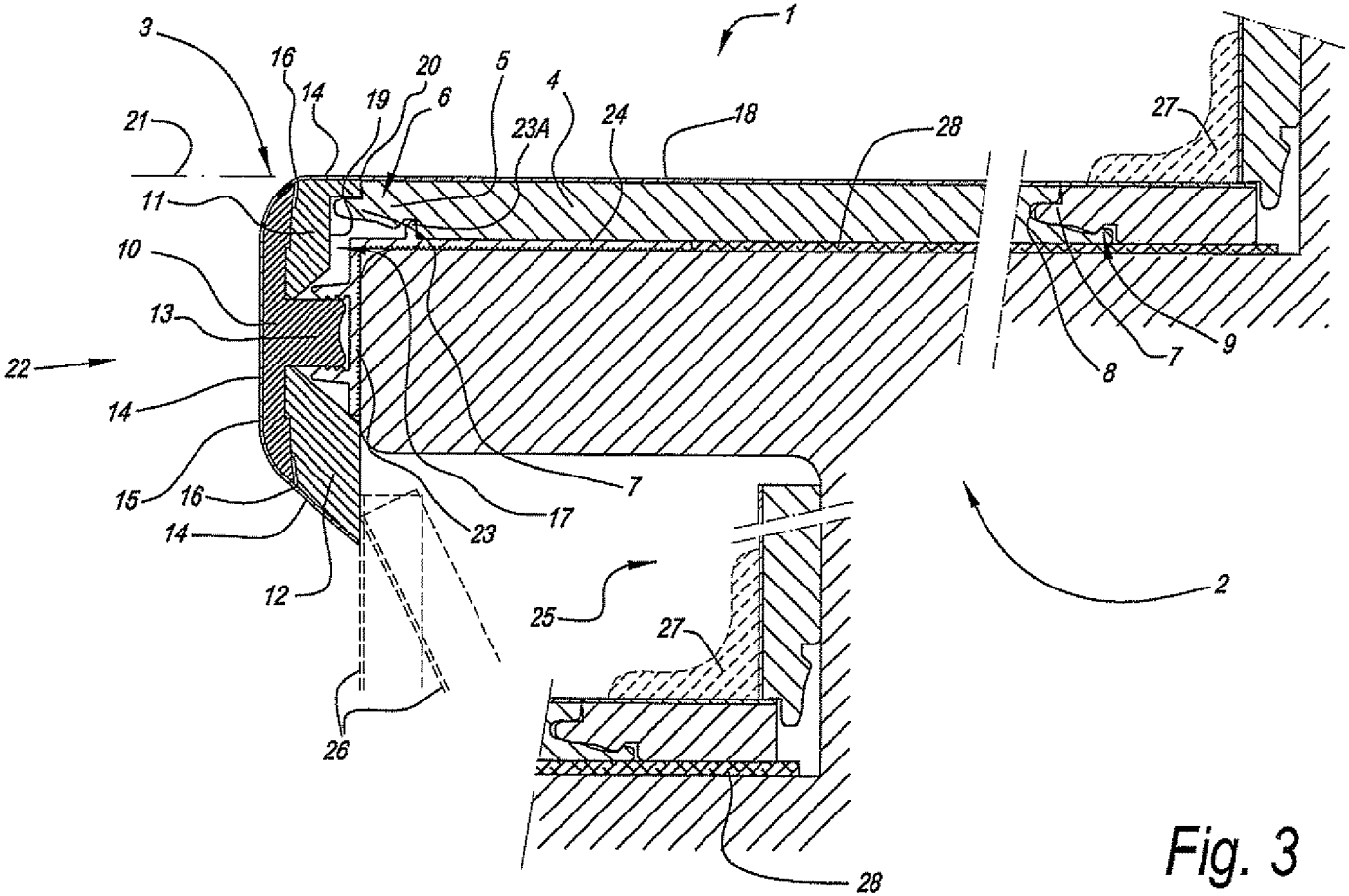
FIGS. 3 to 5, in a view similar to that of FIG. 1, represent finishings for a staircase, which make use of the profile from FIG. 2.

FIG. 3 represents a finishing of another step or staircase 2. Herein, this relates to a step which as such already comprised a stair nose 22. In dashed lines 26, two variants are shown, wherein the rising flanks 25 of the step 2 possibly can be brought forward, such that a possible view on the bottom side of the stair nose 22 is completely avoided. Herein, the floor panel 4 either can be provided vertically or can be applied in an inclined manner.

Figure 4:
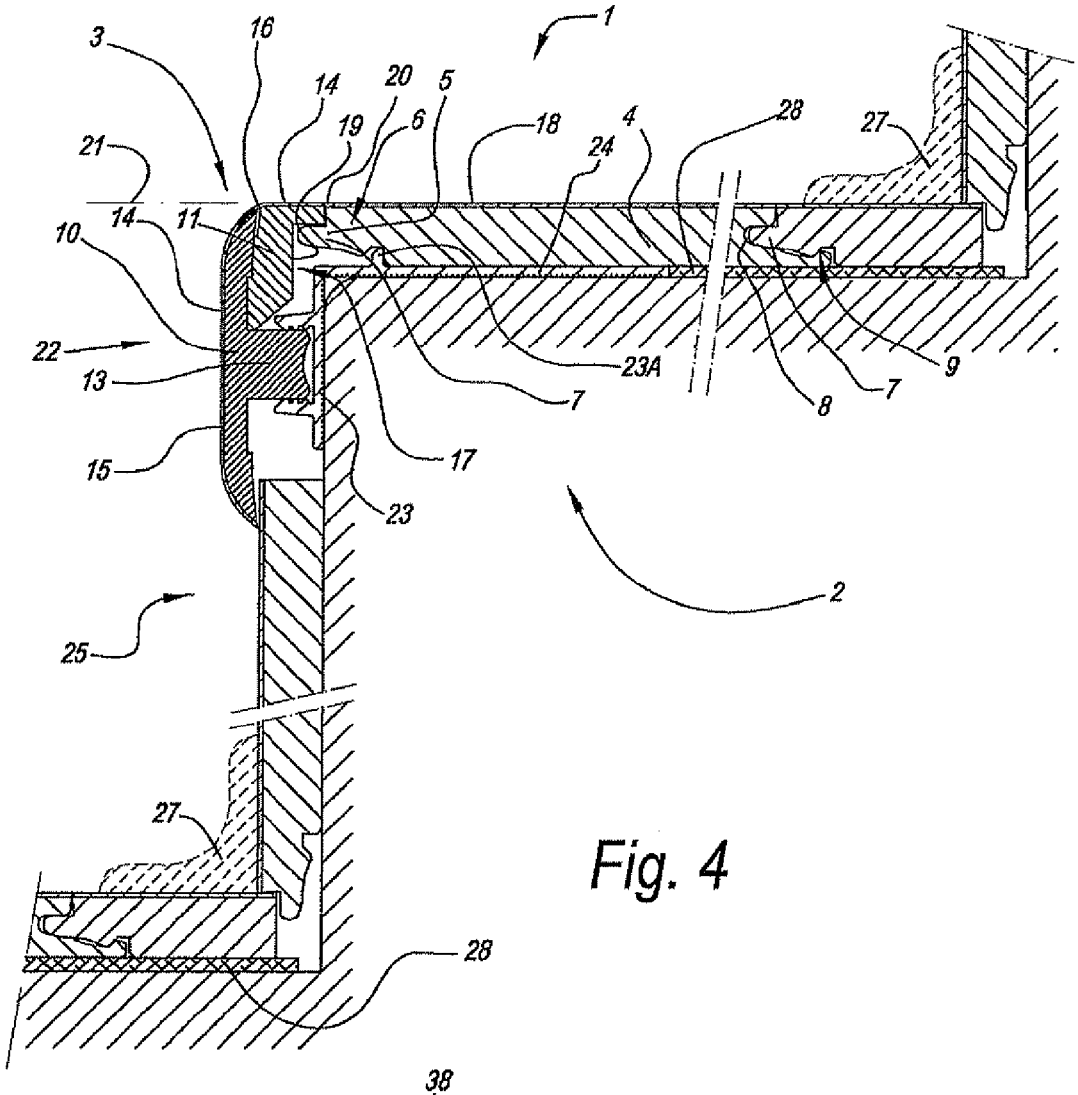

FIG. 4 represents a variant of the finishing of FIG. 1, wherein the same decorative strip 3 is used as in the preceding figures, however, wherein one of the nose portions 12 is removed, namely the nose portion 12 with the smallest inclination B. For the rest, the finishing is similar to that of FIG. 1. In this manner, a less pronounced stair nose 22 is obtained.

It is clear that in FIG. 3 as well as in FIG. 4 a so-called "flush" finishing is obtained.

Figure 5:
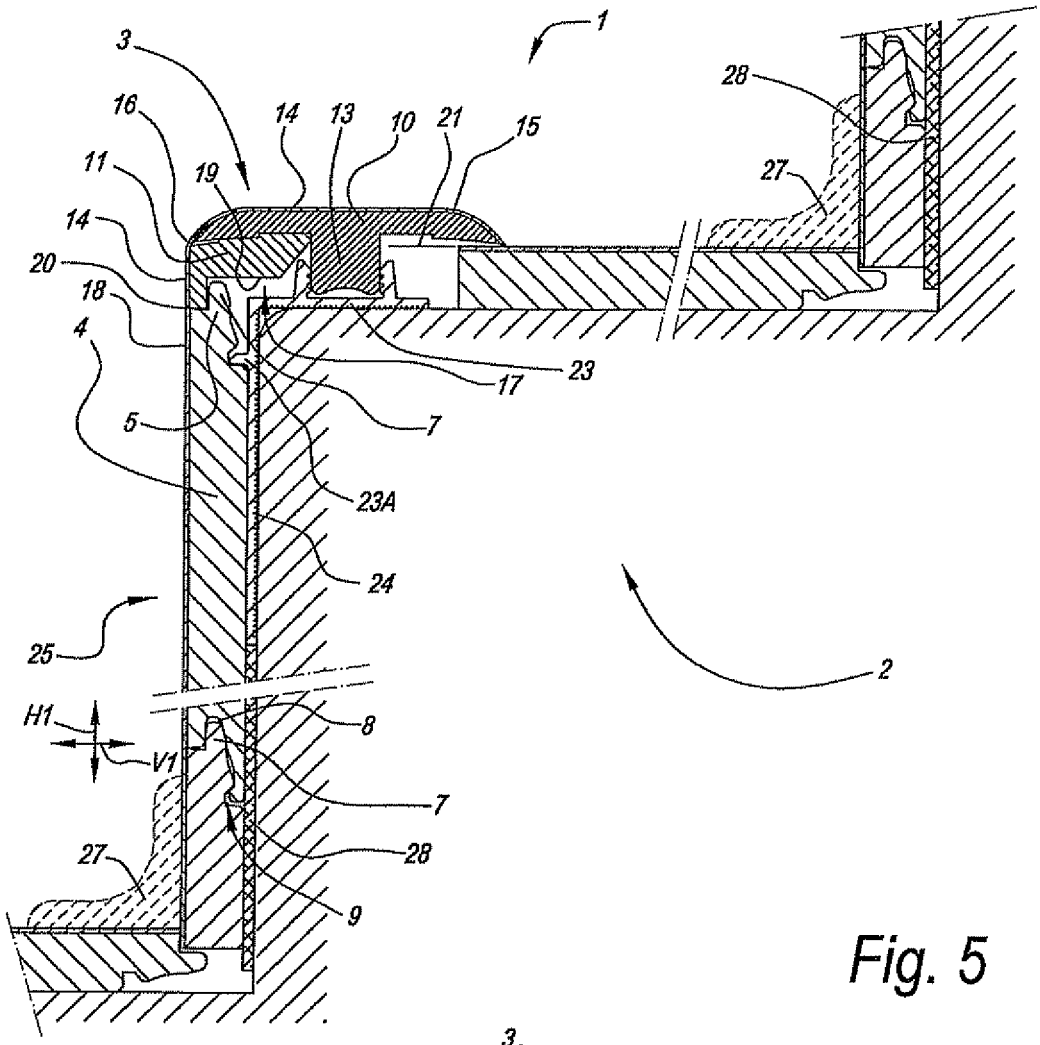

FIG. 5 represents another embodiment, wherein by means of the same decorative strip 3 on the step a finishing is obtained which is not "flush"; wherein, in other words, the decorative side 14 of the decorative strip is coming out of the plane 21 of the finished step. Herein, the decorative strip 3 covers a portion of the surface of the step, whereas the floor panel 4, with which the decorative strip 3 cooperates, forms a rising flank 25 of this step. Herein, also one of the nose portions 12 is removed. This also relates to the nose portion 12 with the smallest inclination B, which is removed.

FIGS. 1 and 3 to 5 further also show that possibly, a profile 27 can be applied for finishing the inner corners of the staircases or steps of the examples; however, this is not necessary. These figures further also show that a subfloor 28 can be provided underneath one or more floor panels of the staircase covering. Preferably, at least a subfloor 28 is applied underneath the floor panels which cover the horizontal surface of the step concerned. However, it is not excluded that, as represented in FIG. 5, such subfloor 28 is also or only applied underneath the floor panels which cover the rising flanks 25 of the step.

The floor panels 4 represented in the figures respectively show the same thickness. As noted, the attachment rail 23 can be adapted for enabling a finishing with floor panels 4 of another thickness. Possibly, to this aim an adjustable attachment rail can be provided. According to a preferred embodiment, it is possible to separate the legs of the L-shaped attachment rail 23, such that this rail 23, or at least a remaining part thereof, can also be applied for the finishing of floor coverings on a horizontal underlying surface, for example, for attaching transition profiles, expansion profiles, end profiles and/or skirting boards. For such separation, a weakened material portion can be provided in the corner point of the L-shaped rail 23 or on the leg cooperating with the attachment part. According to another preferred embodiment, it is possible to provide the legs of the L-shaped attachment rail parallel to each other and underneath each other without separating them, for example, in that a hinge portion is provided in the corner point of the L-shaped rail 23. In this manner, too, the rail 23 can be applied in a useful manner for the attachment of finishing profiles for floor coverings.

In connection with the attachment rail 23, it is also noted that it can be provided with positioning means 23A allowing to bring the floor panel 4 and the decorative strip 3 in a mutual position in which a "flush" finishing is obtained. In the figures is represented that the part 11 rests on the tongue 7. Preferably, in all directions, however, a certain play is provided between the profiled surface and the coupling means concerned.

Figure 6:
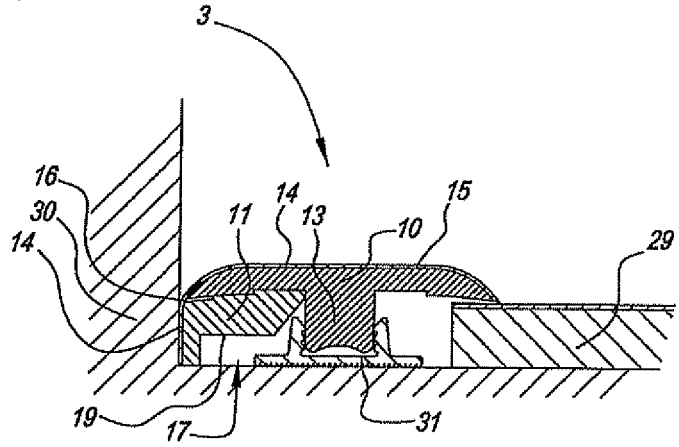
FIG. 6 represents another application possibility of the decorative strip of FIG. 2.

By means of illustration of the invention, FIG. 6 also shows that the decorative strip 3 of FIG. 2, after removal of the nose portion 12 with the smallest inclination B, can be applied for finishing a floor covering 29 against a wall. In a similar manner, when removing both nose portions 11-12, a finishing as an expansion profile can be obtained, and, when removing only the nose portion 11 with the largest inclination A, a finishing as a transition profile can be obtained. The attachment rail 31 applied here may relate, for example, to a remaining portion of the attachment rail 23 from preceding figures, which is obtained by separating one of the legs 24 of the L-shaped rail.

Figure 7:
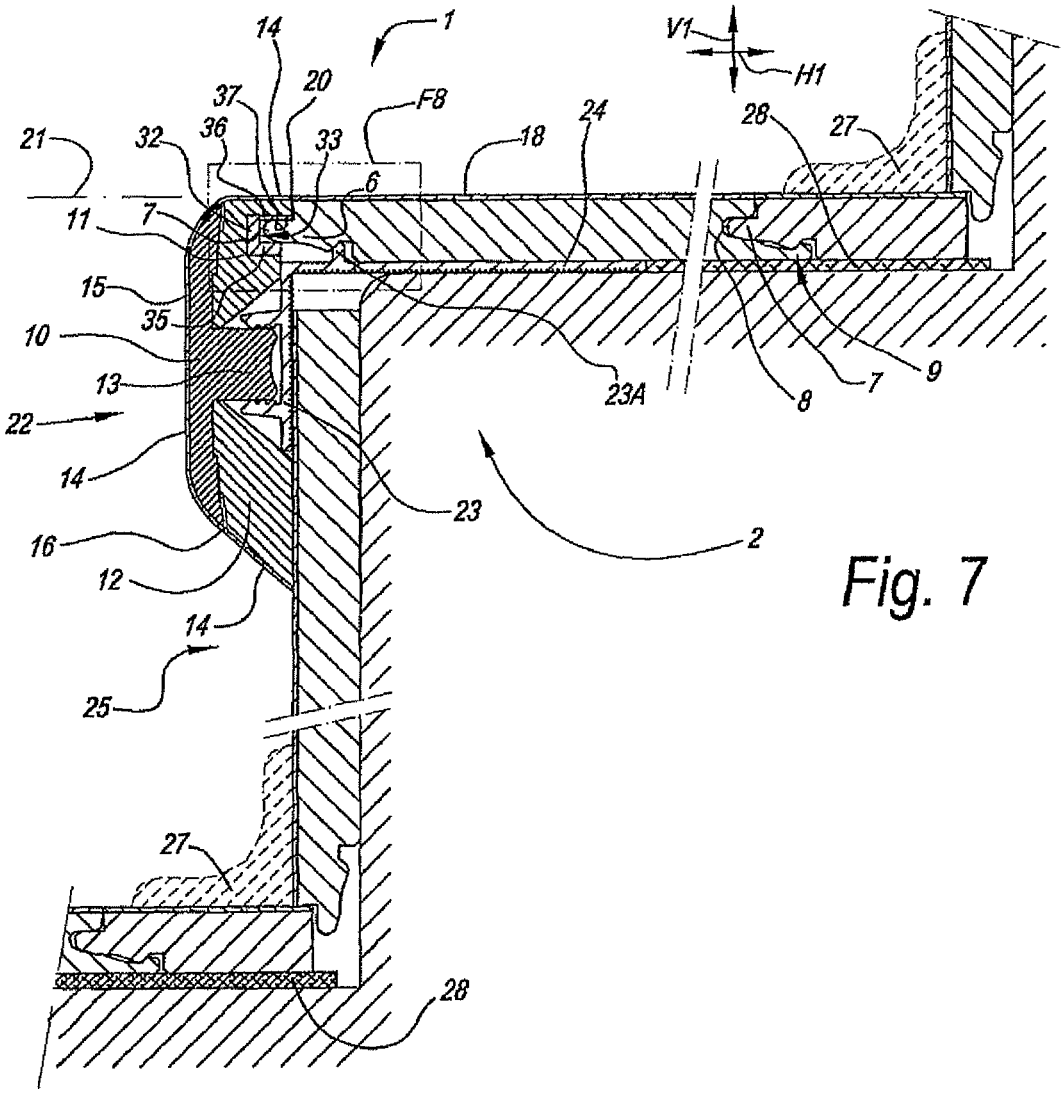
FIG. 7 represents a finishing with the characteristics of the invention.

FIG. 7 represents a finishing 1 for a staircase 2 with the characteristics of the first and second aspects of the invention mentioned in the introduction. To this aim, the finishing 1, apart from a floor panel 4 and a decorative strip 3, also comprises at least an adapting profile 32, which cooperates with the body of said decorative strip 3. The adapting profile 32 comprises a surface 33, which, at the location of said coupling means 6 of the floor panel 4, extends transverse in respect to the decorative side 18 of the floor panel 4. The respective surface 33 shows a profile, which offers room for at least a portion of said coupling means 6, in this case the tongue 7. Here, this relates to an adapting profile 32, which is provided in an undercut 34, in this case having the form of a groove, provided in the body of the decorative strip 3. In the example, a multi-part decorative strip 3 is represented, wherein the undercut is performed in at least one of the parts 11 of this body. The adapting profile 32 can be attached by means of glue, however, it may also be retained in the groove purely by friction or other mechanical adherence.

The adapting profile 32 has a U-shaped cross-section, which comprises at least a groove flanked by a lower lip 35 and an upper lip 36. Said coupling means 6 in the form of a tongue 7 is at least partially provided in said groove.

Figure 8:
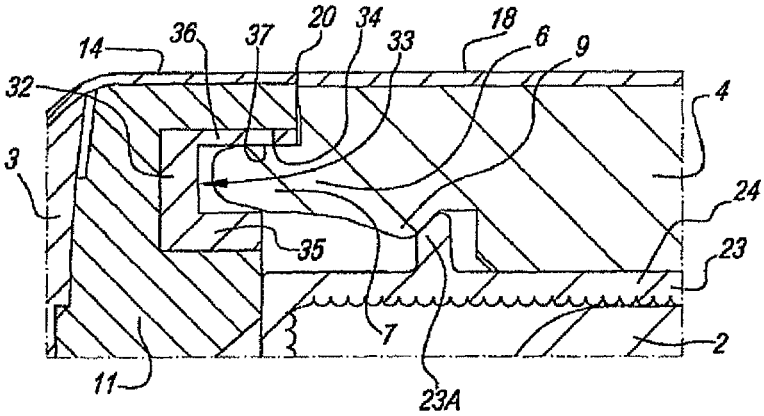
FIG. 8, at a larger scale, represents a view on the area indicated by F8 in FIG. 7.

FIG. 8 clearly shows that the adapting profile 32, in this case, is chosen such that a vertically active contact surface 37 is created between the adapting profile 32 and the coupling means 6, more particularly the tongue 7, of the floor panel 4. This contact surface 37 is situated on the upper side of the tongue 7 and on the lower side of the upper lip 36 of the adapting profile 32 and prevents a movement of the floor panel 4 in vertical direction V1 away from the surface of the staircase 2. In this manner, even on the basis of warped floor panels 4 a flat finishing, without height differences, can be obtained, namely with 20 between the respective decorative sides 14-18 of the decorative strip 3 and floor panel 4 or floor panels. Namely, in such case the vertically active contact surface 37 exerts a downward pressure on the coupling means 6, such that the panels 4, in cooperation with the decorative strip 3, remain flat.

Referring to FIGS. 7 and 8, it is noted that the lower lip 35 of the adapting profile 32 and the portion connecting the lower lip 35 and upper lip 36 in the example as such have no other function than simplifying the attachment of the adapting profile 32 in the undercut 34. An equivalent embodiment should thus be obtained by providing an adapting strip at the location of the upper lip 36 represented in FIG. 8.

From FIGS. 7 and 8, it is clear that the adapting profile 32 adapts the decorative strip 3 for the cooperation with the floor panel 4 represented there, more particularly with the specific position and shape of the coupling means 6 concerned, in this case of the tongue 7. For the cooperation of the decorative strip 3 with floor panels 4 of the same thickness, however, with elsewhere-positioned coupling means 6, the adapting profile 32 can be exchanged for an adapting profile 32 with an appropriate, preferably U-shaped cross-section, for forming a vertically active contact surface 37 on the elsewhere-positioned coupling means 6. For the cooperation of the decorative strip 3 with floor panels 4 of another thickness, preferably at least the attachment rail 24 is exchanged, such that also with thicker or thinner floor panels 4, a so-called "flush" finishing 1 can be obtained by means of the same decorative strip 3.

Figure 9:
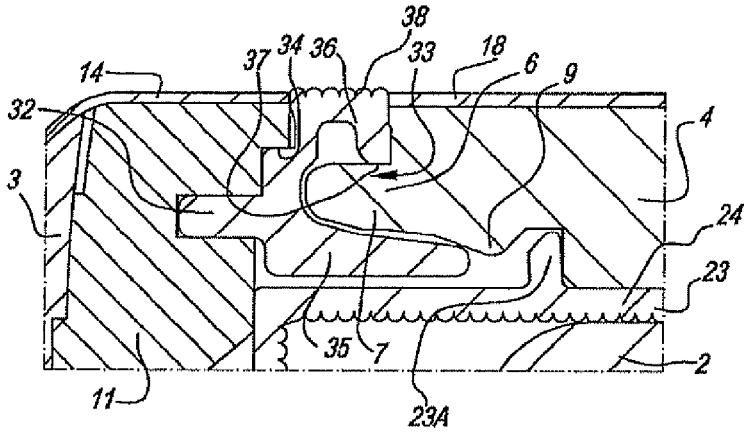
FIG. 9, in a similar view, represents a variant of a finishing with the characteristics of the second aspect of the invention.

FIG. 9 represents another example of a finishing 1 with the characteristics of the second aspect. Herein, the adapting profile 32 again is attached in an undercut 34 of the decorative strip 3, in the form of a groove. The adapting profile 32 has a U-shaped cross-section and a vertically active contact surface 37 between the lower side of the upper lip 36 and the upper side of the coupling means 6. The embodiment of FIG. 9 shows two important differences with the embodiment of FIGS. 7 and 8. A first difference consists in that the adapting profile 32 extends with the part 38 into the surface of the finished step 2, where it forms an anti-slip strip and/or a decorative strip. A second difference consists in that the decorative side 14 of the decorative strip 3 extends in horizontal direction H1 up to a vertical plane V2 situated at a distance D from the distal extremity of the coupling means 6 or the tongue 7, such that this plane V2 does not intersect the coupling means 6. It is clear that the aforementioned differences each can be present separately. The embodiment of FIG. 9 further has the advantage that said undercut 34 can be made less interfering than it is the case when the actual decorative strip 3 at least partially covers the coupling means 6. Hereby, it is obtained that the decorative strip 3 in another application, such as, for example, in the application represented in FIG. 6, also retains sufficient stability.

It is clear that, although in the examples the decorative strip 3 and/or the adapting profile 32 always cooperate with a coupling means 6 in the form of a tongue 7, similar finishings 1 can be obtained when the decorative strip 3 and/or the adapting profile 32 cooperate with a coupling means 6 having the form of a groove 8.

It is also noted that the decorative strip of the invention preferably comprises a body on the basis of wood-based material, such as, for example, on the basis of plywood or MDF, HDF (Medium Density Fiberboard or High Density Fiberboard). In the case that the decorative strip cooperates with laminate floor panels, it preferably comprises a decorative side formed by a layer-shaped covering, preferably on the basis of a film or a laminate. In the case that the decorative strip cooperates with floor panels with a wooden top layer or with solid parquet, it preferably comprises a decorative side formed by a layer-shaped covering, preferably on the basis of veneer. Preferably, in each case a decorative side of the decorative strip is used which matches the decorative side of the floor panel.

Further, it is noted that the adapting profiles mentioned, for example, in the second aspect of the invention, preferably are manufactured as extrusion profiles and/or preferably substantially consist of a material chosen from the list of aluminum, synthetic material and wood extrusion material. For the attachment rail, preferably also use is made of extruded profiles and/or of similar materials. However, it is not necessary that the adapting profile and the attachment rail of the same finishing consist of the same material. The materials hereof can be freely chosen and combined from the possibilities thereof mentioned herein above.

The present invention is in no way limited to the herein above-described embodiments; on the contrary, such finishings, decorative strips and attachment rails can be realized according to various variants, without leaving the scope of the present invention.

The invention claimed is:

1. Finishing for a staircase or step, comprising at least a decorative strip and a floor panel, said decorative strip comprising a body which is provided with a decorative side and wherein said floor panel also comprises a decorative side and is provided with a profiled edge region in the form of a coupling means of the type enabling connection to a plurality of such floor panels to each other at their edges, said finishing also comprising an adapting profile inserted within and abutting an undercut formed by the body of said decorative strip, said adapting profile comprising a surface, which, at the location of said coupling means of the floor panel, extends transversely with respect to the decorative side of the floor panel, so that the surface has a profile providing room for at least a portion of said coupling means;

wherein the adapting portion defines a U-shaped cross-section including a lower lip and an upper lip with a groove therebetween, the adapting portion being separate formed from the undercut.

2. The finishing of claim 1, wherein said adapting profile comprises a vertically active contact surface with said coupling means.

3. The finishing of claim 1 or 2, wherein said decorative strip comprises a body, which as such comprises a plurality of parts.

4. The finishing of claim 1 or 2, wherein the decorative side of the decorative strip and the decorative side of the floor panel adjoin each other.

5. The finishing of claim 1 or 2, wherein the adapting profile has a U-shaped cross-section, which comprises at least a groove flanked by an upper lip and a lower lip, and wherein said coupling means is made in the form of a tongue, wherein the tongue is at least partially provided in said groove.

6. Finishing for a staircase or step, wherein this finishing comprises at least a decorative strip and a floor panel, wherein said decorative strip has a body comprising a plurality of parts provided with a decorative side, and wherein said floor panel also comprises a decorative side and is provided with a profiled edge region in the form of a coupling means of the type allowing to couple a plurality of such floor panels to each other at their edges, wherein the decorative side of the decorative strip and the decorative side of the floor panel adjoin each other, wherein at least one of said parts of the body of the decorative strip comprises a surface, which, at the location of the connection of the respective decorative sides of the decorative strip and the floor panel, extends transverse in respect to the decorative side of the floor panel, wherein said surface shows a profile which offers room for at least a portion of said coupling means, said decorative strip defining a flange-shaped part provided with an attachment portion on a lower side and forming a T-shaped cross-section;

the finishing including an attachment rail cooperating with the attachment portion of the decorative strip, the attachment rail substantially configured in an L-shape having a longer leg provided underneath the floor panel and a shorter leg coupling to the attachment portion of the decorative strip.

7. The finishing of claim 1 or 6, wherein said decorative sides adjoin each other without overlapping each other thereby.

8. The finishing of claim 1 or 6, wherein said decorative sides at said connection are situated in the same plane.

9. The finishing of claim 1 or 6, wherein said decorative strip and said floor panel are positioned with their longitudinal direction parallel and with their width direction transverse to each other, wherein the decorative strip, at choice, either is provided on a step or covers or forms the stair nose.

10. The finishing of claim 1 or 6, wherein said parts of the decorative strip are connected to each other at least by means of a layer-shaped covering, wherein said layer-shaped covering forms said decorative side.

11. Kit for forming a finishing of claim 1 or 6, wherein said kit meets at least one of the following features:

the kit comprises a decorative strip, which forms at least the stair nose, and an attachment rail;

the kit comprises an attachment rail and an adapting profile;

the kit comprises a decorative strip, which forms at least the stair nose, and an attachment rail.

* * * * *